US006922953B1

(12) United States Patent
Lewis

(10) Patent No.: US 6,922,953 B1
(45) Date of Patent: Aug. 2, 2005

(54) DIAMOND POST STABILIZER

(75) Inventor: Randy Lewis, Charlotte, NC (US)

(73) Assignee: Erosion Control Products, Inc., Charlotte, NC (US)

( * ) Notice: Subject to any disclaimer, the term of this patent is extended or adjusted under 35 U.S.C. 154(b) by 114 days.

(21) Appl. No.: 10/237,841

(22) Filed: Sep. 9, 2002

(51) Int. Cl.[7] ..... E04G 1/00

(52) U.S. Cl. ..... 52/126.1; 52/127.2; 52/170; 52/651.11; 52/677; 211/175; 211/182; 248/354.4; 248/354.5; 248/354.6; 256/20; 269/9; 269/55; 269/287

(58) Field of Search ..... 52/126.3, 127.2, 52/170, 651.11, 126.1, 6.77; 256/20, 23, 256/32, 59; 211/189, 190, 175, 182; 248/354.4, 248/512, 519, 523, 539; 269/9, 16, 17, 36, 269/58, 287, 329

(56) References Cited

U.S. PATENT DOCUMENTS

| | | | | | |
|---|---|---|---|---|---|
| 1,262,776 | A | * | 4/1918 | Gohl | 248/512 |
| 1,512,831 | A | * | 10/1924 | Dunnell et al. | 248/512 |
| 1,893,585 | A | * | 1/1933 | Hogan | 248/512 |
| 2,498,203 | A | | 2/1950 | Fischer | 5/98 |
| 2,771,088 | A | | 11/1956 | Soldan | 135/5 |
| 3,966,153 | A | * | 6/1976 | Fleck | 248/512 |
| 4,008,499 | A | | 2/1977 | Wren, Jr. et al. | 5/99 C |
| 4,815,736 | A | | 3/1989 | Wright | 273/26 A |
| 4,887,786 | A | * | 12/1989 | Stokes | 248/512 |
| 4,930,718 | A | | 6/1990 | Lancour et al. | 242/86.5 R |
| 5,291,708 | A | | 3/1994 | Johnson | 52/282.2 |
| 5,660,505 | A | | 8/1997 | Emory, III | 405/258 |
| 5,758,868 | A | | 6/1998 | Shea | 256/12.5 |
| 5,915,878 | A | | 6/1999 | Carpenter | 405/38 |
| 5,930,971 | A | * | 8/1999 | Etheridge | 52/646 |
| 5,943,798 | A | | 8/1999 | McGuire et al. | 37/367 |
| 5,954,951 | A | | 9/1999 | Nuccio | 210/87 |
| 5,971,345 | A | * | 10/1999 | Khalaf | 248/512 |
| 6,004,457 | A | | 12/1999 | Singleton | 210/163 |
| 6,053,665 | A | | 4/2000 | Richardson | 405/258 |
| 6,059,964 | A | | 5/2000 | Strawser, Sr. | 210/164 |
| 6,419,201 | B1 | * | 7/2002 | Hughes et al. | 248/514 |
| 6,502,708 | B2 | * | 1/2003 | Daniel | 211/189 |

* cited by examiner

*Primary Examiner*—Jeanette E Chapman
(74) *Attorney, Agent, or Firm*—Kennedy Covington Lobdell & Hickman, LLP

(57) ABSTRACT

A device for stabilizing a plurality of spaced posts comprising an outer frame member; a plurality of bracket assemblies mounted to the outer frame member at a first set of spaced locations thereon to receive the posts; and a plurality of bracing members extending between a second set of spaced locations on the outer frame member, intermediately of the first spaced locations, for stabilizing the outer frame member.

30 Claims, 3 Drawing Sheets

DIAMOND POST STABILIZER

FIELD OF THE INVENTION

The present invention relates to a device for stabilizing posts and, more particularly, to a device for stabilizing the posts of a silt fence to prevent the posts from leaning or toppling and, thereby, allowing sediment and debris to enter the area protected by the silt fence.

BACKGROUND OF THE INVENTION

During the construction process, it is particularly important to protect storm drain inlets from eroding sediment and debris that can clog the drains. Various forms of silt fence devices and other apparatuses intended to control the flow of sediment and debris are known in the art. Such devices and apparatuses perform with various degrees of success in containing the flow of sediment and debris.

One of the cheapest and most common methods of protecting storm drain inlets at construction sites is to place a post adjacent to each corner of the storm drain inlet and to wrap a silt fence fabric around the posts. A small portion of the fabric is allowed to extend beyond the bottom end of the posts to form a skirt around the silt fence structure. Stone or dirt is then placed over the skirt in an attempt to hold the silt fence structure in place.

Unfortunately, over a period of time, eroding sediment and debris from the construction site builds up around the drain putting pressure on the silt fence. As a result of the retained moisture around the drain area and the pressure of the eroding sediment and debris against the silt fence, the posts of the silt fence begin to lean inward, allowing the silt fence material to droop and, in some cases, to topple letting the silt fence material completely touch the ground. Because the posts of the silt fence structure are no longer in their vertical upright position, the eroding sediment and debris is allowed to enter the storm drain inlets, causing the storm drains to clog.

Other disadvantages of known prior art for protecting storm drain inlets during the construction process are the: (i) cost of procuring the devices, (ii) limited access that is provided to the drain inlets after installation of the devices, (iii) inability of the devices to sufficiently prevent sediment and debris from entering the storm drain inlets because of their height and/or means of installation, and (iv) requirement, in some cases, to remove the storm drain inlets to install the devices.

Thus, it is desirable to have a low-cost device or apparatus that stabilizes the commonly used silt fence structures so storm drain inlets can effectively be secured from eroding sediment and debris from the construction site. Likewise, it is desirable that once the silt fence structure is installed, construction personnel can access the storm drain inlet without having to de-install the silt fence structure.

Heretofore, various forms of silt fence devices and apparatuses associated thereto have been designed; however, none of these designs completely embody the desirable qualities above. Information relevant to attempts to address these problems can be found in U.S. Pat. Nos. 6,004,457; 5,758,868; 5,660,505; 6,059,964; and 5,954,951.

U.S. Pat. No. 6,004,457 relates to a temporary silt guard in which the silt guard, having a series of spaced slats radially spaced through the silt guard, is adapted to fit over and seat upon the open end of the storm drain, thereby, forming an enclosure over the storm drain. A filter cover made from a silt screen material is placed over the silt guard to prevent sediment and debris from entering the storm drain inlet.

U.S. Pat. No. 5,758,868 relates to an improvement in the manner of securing the silt fencing material to the fencing posts to make the silt fence more wind-resistant and maintenance-free and comprises a plurality of post units comprising three contiguous elongated hollow tubes. The central tube is adapted to receive stabilizing steel rebar posts, and the two outer tubes each contain slits along their length to receive rigid rods that are attached to the silt fencing material.

U.S. Pat. No. 5,660,505 relates to a silt fence anchor device having interlocking members that protrude from a base that is designed to clamp onto the lower edge of the silt fence. Once the silt fence is clamped into the device, the device and attached silt fence are buried.

U.S. Pat. No. 6,059,964 relates to a collapsible catch basin grate filter assembly consisting of spaced-apart open frame elements that are joined to and carry a singular mesh fabric filter element. The filter assembly has manually pivotable support leg elements.

U.S. Pat. No. 5,954,951 relates to a filter assembly for storm drainage and gutter-type catch basins consisting of a pair of spaced-apart, rectangular, metal frame elements sized to over the gutter inlet and curb inlet openings; a single flexible silt and debris filter element secured to the metal frame elements; and clamps for removably securing the filter assembly to the frame and grate elements of the catch basin cover.

Until now, however, there has not been a low-cost device or other apparatus that completely stabilizes the commonly used silt fence structure, effectively securing storm drain inlets from eroding sediment and debris from the construction site and, likewise, upon installation, allowing construction personnel to access the storm drain inlet without having to de-install the structure.

SUMMARY OF THE INVENTION

It is accordingly an object of the present invention to provide a device for stabilizing the posts of the commonly used silt fence structure. More particularly, it is the object of the present invention to stabilize the posts of the silt fence structure to prevent the posts and silt fence fabric from faltering when eroding sediment and debris are washed up against the silt fence structure. Another object of the present invention is to allow construction personnel access to the storm drain inlets once the stabilized silt fence structure is installed, without requiring the construction personnel to remove or de-install the stabilized silt fence structure.

Briefly described, the objects of the present invention are achieved in a stabilizing device wherein the stabilizing device comprises: an outer frame member; a plurality of bracket assemblies mounted to the outer frame member at a first set of spaced locations thereon, each said bracket assembly being configured for receiving one of the posts; and a plurality of bracing members extending between a second set of spaced locations on the outer frame member intermediately of the first spaced locations for stabilizing the outer frame member.

In the preferred embodiment, the outer frame member is in the form of a polygon and is comprised of four angularly oriented outer rods. The outer frame member defines a stabilizing plane. The outer rods of the outer frame member are fixedly connected to the bracket assemblies positioned in the corners of the outer frame member. The outer rods are made from metal and welded to the ends of the bracket assemblies.

The bracket assemblies are comprised of a cylindrical sleeve for receiving one of each said post, a nut connected to the cylindrical sleeve, and a bolt that can be threaded into the nut to secure the post in the upright or vertical position in the cylindrical sleeve. Each cylindrical sleeve is positioned at one corner of the outer frame member with its axis generally perpendicular to the axis of the stabilizing plane. A nut is attached to the upper rim of each cylindrical sleeve and is positioned so that its axis is generally parallel to the stabilizing plane. Further, the nut is positioned to allow the bolt to enter (i.e., threaded) the nut at a 135 degree angle to the outer most corner of the outer frame member. The bolt is threaded into the nut to secure the post inserted in the cylindrical sleeve in the upright or vertical position.

The bracing members are circular shaped and define a bracing square within the outer frame member. The bracing members are formed from metal with the ends of the bracing members being connected to the intermediate locations of each of the outer frame members by welding. Due to the location of the bracing members within the outer frame member, construction personnel are allowed easy access to the storm drain inlets.

Accordingly, the present invention, provides a device for stabilizing the posts of a silt fence structure preventing the posts and silt fence fabric from faltering when eroding sediment and debris are washed up against the silt fence structure. In addition, the present invention allows construction personnel access to the storm drain inlets once the stabilized silt fence structure is installed, without requiring the construction personnel to remove or de-install the stabilized silt fence structure.

Although the preferred embodiment has been described above, it should be understood that the present invention could be adapted to other embodiments other than the preferred embodiment as described herein. The disclosed advantages of the present invention, and others, will become apparent upon reading the following detailed description and appended claims, and upon reference to the accompanying drawings.

BRIEF DESCRIPTION OF THE DRAWINGS

For a more complete understanding of the present invention, reference should now be had to the preferred embodiment of the present invention as described below and illustrated in greater detail in the accompanying drawings, which are not necessarily to scale.

DETAILED DESCRIPTION OF THE INVENTION

The present invention will be described more fully hereinafter with reference to the accompanying drawings, in which one preferred embodiment of the invention is shown. This invention may, however, be embodied in many different forms and should not be construed as limited to the embodiment set forth herein. Rather, this embodiment is provided so that this disclosure will be thorough and complete and will fully convey the scope of the invention to those skilled in the art.

Figure 1:
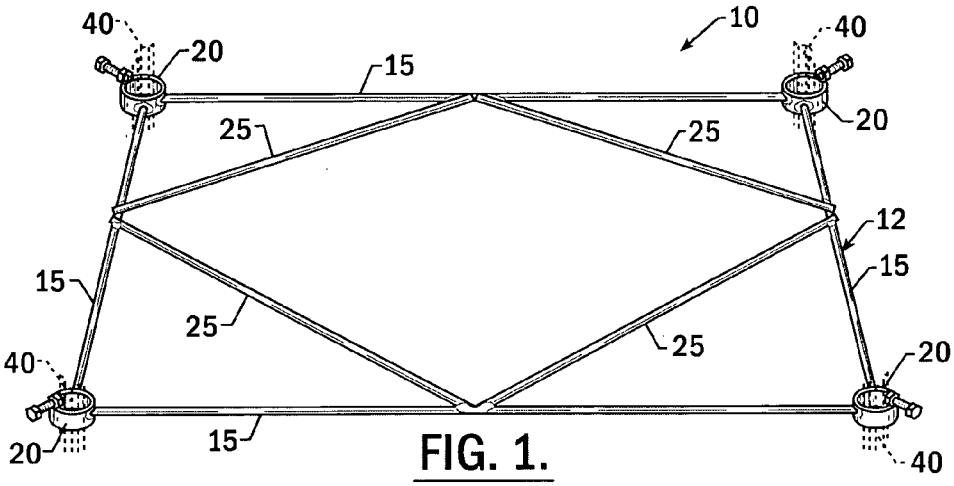
FIG. 1 is a perspective view of an embodiment of the stabilizing device of the present invention.

Turning now to the accompanying drawings and initially FIG. 1, the stabilizing device in accordance with the present invention is illustrated in its totality at 10. The stabilizing device 10 comprises an outer frame member 12; a plurality of bracket assemblies 20 mounted to the outer frame member 12 at a first set of spaced locations thereon, each said bracket assembly 20 being configured for receiving one of the posts 40; and a plurality of bracing members 25 extending between a second set of spaced locations on the outer frame member 12, intermediately of the first spaced locations, for stabilizing the outer frame member 12.

In the preferred embodiment, shown in FIG. 1, the outer frame member 12 is comprised of four outer rods 15 that are angularly oriented to form a rectangle. Despite the rectangular shape of the outer frame member 12 in the preferred embodiment, the outer frame member 12 can be in the form of a polygon. Preferably, the outer rods 15 are made from metal, however, any other suitable material as determined by one skilled in the art may be used. The outer rods 12 are fixedly connected (i.e., welded) to the bracket assemblies 20 positioned in each corner of the outer frame member 12. Because the outer rods 15 of the outer frame member 12 are welded and/or fixedly connected to the bracket assemblies 20, the outer rods 15 are immovable, thereby, allowing the outer frame member 15 to define a stabilizing plane for the stabilizing device 10.

Figure 2:
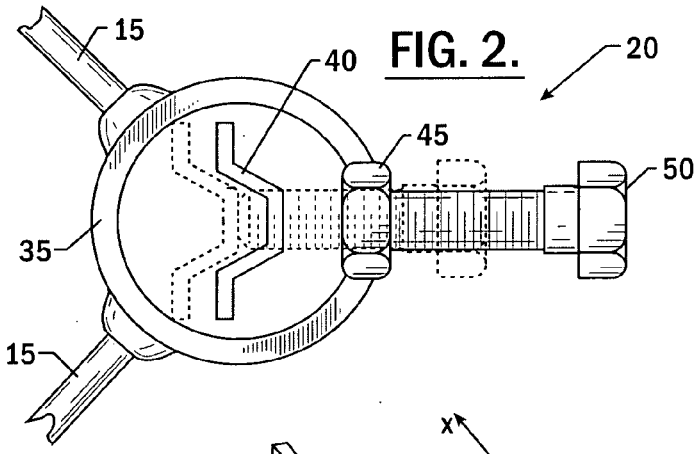
FIG. 2 is a top view of the bracket assembly of FIG. 1.
Figure 3:
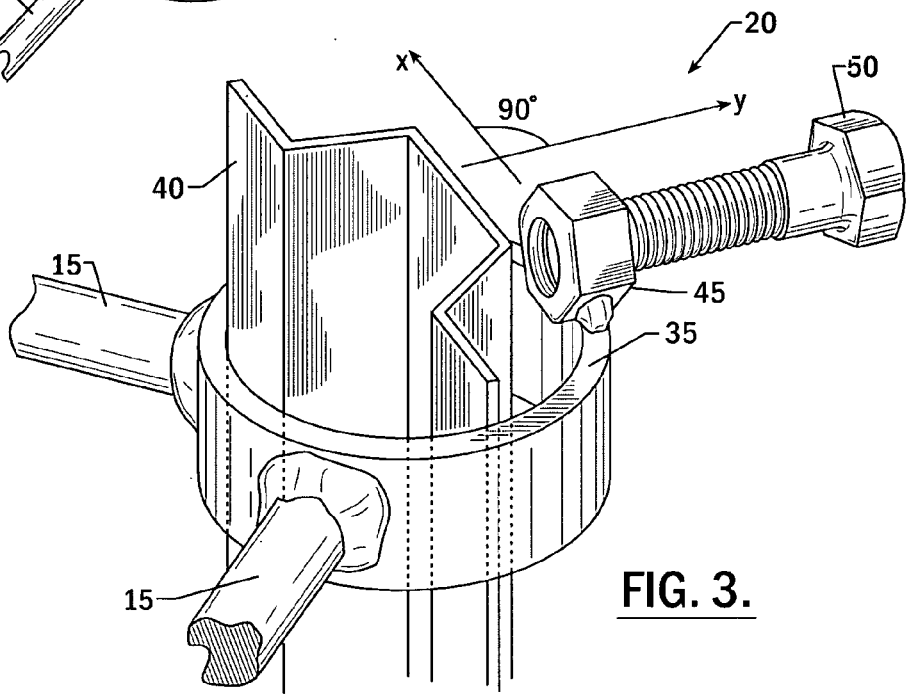
FIG. 3 is a perspective view of the bracket assembly of FIG. 1.

As illustrated in FIGS. 2 and 3, each bracket assembly 20 is comprised of a cylindrical sleeve 35, a nut 45 connected to the cylindrical sleeve 35, and a bolt 50 which can be threaded into the nut 45. A cylindrical sleeve 35 is located in each corner of the outer frame member 12 and is fixedly attached, by welding, to two outer rods 15 angularly oriented and connected thereto. The axis of the cylindrical sleeve 35 is generally perpendicular to the stabilizing plane formed by the outer frame member 12 and is positioned to receive a post 40 in the vertical or upright position.

Attached to the rim of each cylindrical sleeve 35 is a nut 45 that is positioned on the cylindrical sleeve 35 so that the nut's 45 axis is generally parallel to the axis of the stabilizing plane of the outer frame member 12. The nut 45 can be attached to either the upper rim or the lower rim of the cylindrical sleeve 35. FIG. 3 shows attachment of the nut 45 at the upper rim of the cylindrical sleeve 45. In addition, as shown in FIG. 2, the nut 45 is positioned on the cylindrical sleeve 35 to allow a bolt 50 to enter the nut 45 at a 135 degree angle to the outer most corner of the outer frame member 12. The bolt 50 is threaded into the nut 45 for selective movement into and out of clamping engagement with the post 40 to secure the post 40 inserted in the cylindrical sleeve 35 in the upright or vertical position.

Figure 4:
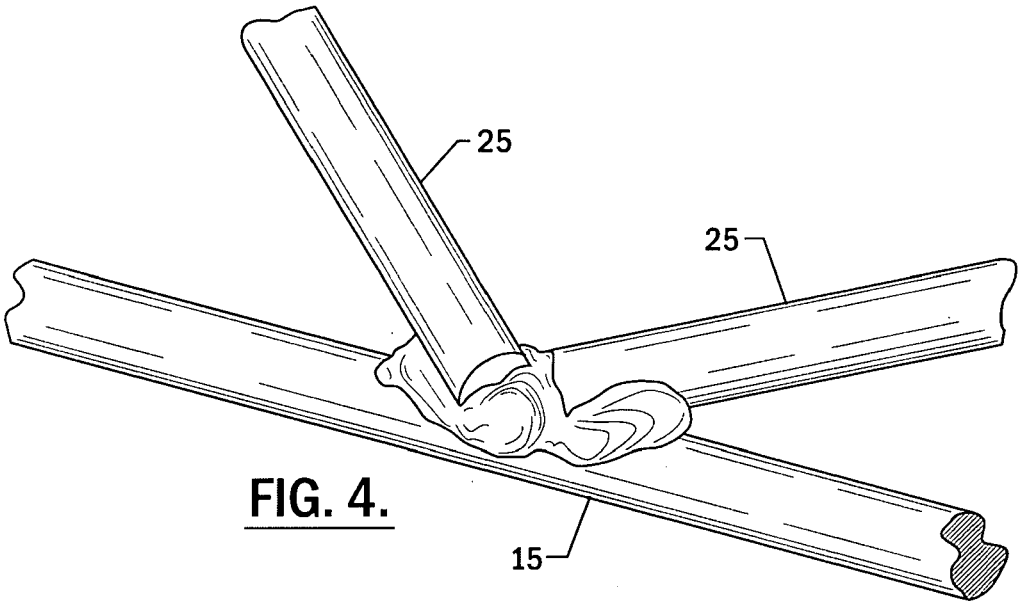
FIG. 4 is a perspective view of the intermediate point of the bracing members and outer frame members of FIG. 1.

Further, as illustrated in FIG. 1, the preferred embodiment of the stabilizing device 10 is comprised of a plurality of bracing members 25. The bracing members 25 extend between intermediate points on the outer rods 15 of the outer frame member 12 and collectively define a bracing square within the outer frame member 12. As shown in FIG. 4, the bracing members 25 are securely affixed to the outer rods 15 of the outer frame member 12 by welding, or other suitable means. The bracing members 25 can be affixed to the outer rods 15 on the topside of the outer rods 15 as shown in FIG. 4 or on the bottom-side of the outer rods 15. Preferably, the bracing members 25 are formed from metal, providing added stability to the outer frame member 12.

Figure 5:
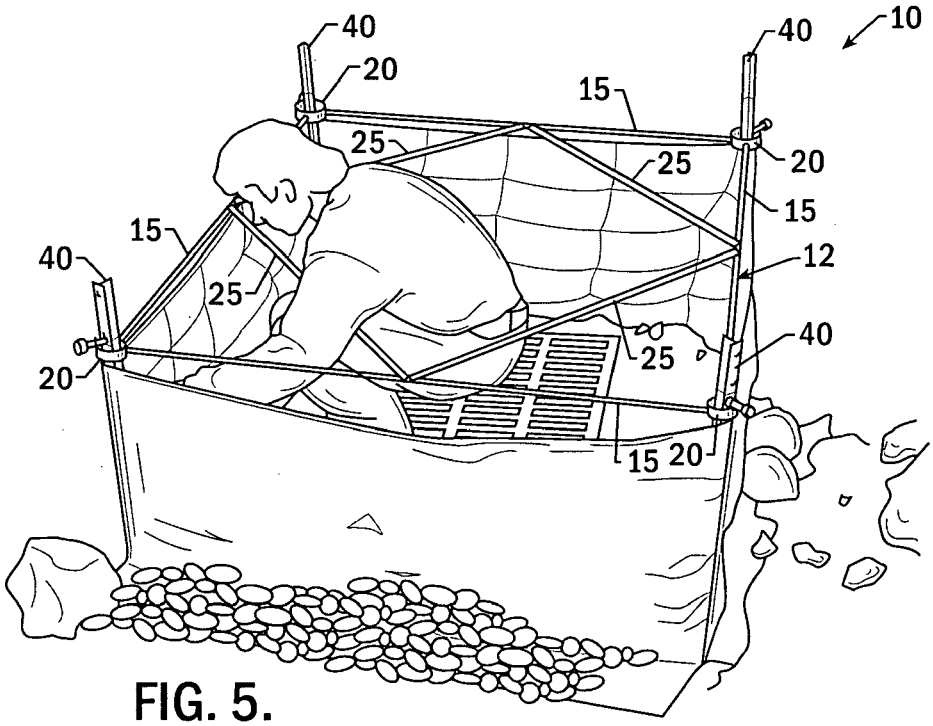
FIG. 5 is a perspective view of an embodiment of the stabilizing device of FIG. 1 after installation.
Figure 6:
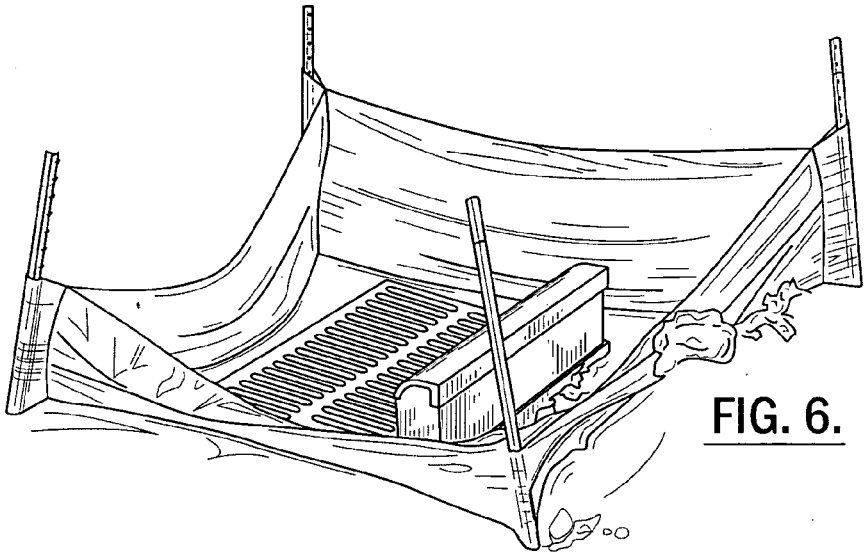
FIG. 6 is a perspective view of a known silt fence arrangement.

Overall, the design of the stabilizing device 10 is particularly advantageous because it provides a low cost means for stabilizing posts for silt fence structures. As illustrated in FIG. 5, when the stabilizing device 10 is installed with the posts 40, the stabilizing device 10 transmits forces between the posts 40 preventing the posts 40 from leaning or toppling from pressure from eroding sediment or debris, or from loose or wet soil surrounding the posts 40. Moreover, because of the placement of the bracing members 25 at the intermediate points of the outer frame member 12 in a bracing square, construction personnel can enter the stabilizing device 10 to access the storm drain inlet being protected by the silt fence structure. As shown in FIG. 6, prior to the present invention, the posts 40 of silt fence structures were highly susceptible to movement because of the lack of a stabilizing means. Hence, the stabilizing device 10 in FIG. 5 is highly advantageous, particularly, to the construction industry.

Figure 7:
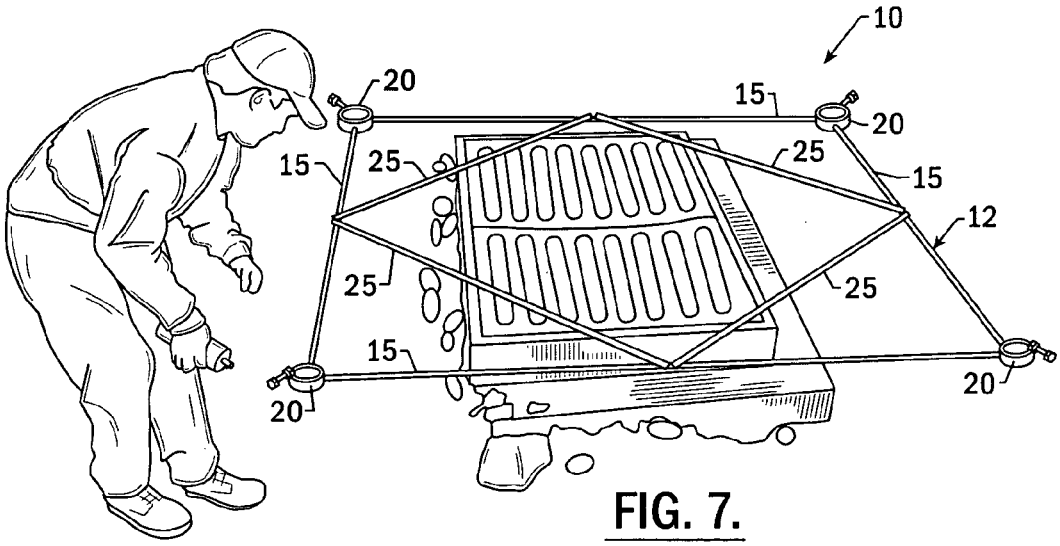
FIG. 7 is a perspective view of an embodiment of the stabilizing device of FIG. 1 prior to installation.

Other advantages of the stabilizing device 10 are its low cost and its ease of installation. As shown in FIG. 7, the stabilizing device can be quickly installed by placing the stabilizing device 10 on the ground over the storm drain inlet. Paint or some other suitable marker may be used to place an identifying mark on the ground in the area within the bracket assemblies to mark the appropriate placement for the posts 40. The stabilizing device 10 can then be removed from the ground and the posts 40 inserted into the ground. Once the posts 40 have been inserted, the stabilizing device 10 can be installed on the posts 40.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that all modifications, alternatives, equivalents and other embodiments are intended to be included within the scope of the appended claims.

What is claimed:

1. A device for stabilizing a plurality of spaced posts comprising:

(a) an outer frame member;

(b) a plurality of bracket assemblies mounted to the outer frame member at a first set of spaced locations thereon, each said bracket assembly being configured for receiving one of the posts, each said bracket assembly comprising:

(i) a cylindrical sleeve for receiving one said post;

(ii) a nut connected to the cylindrical sleeve; and (iii) a bolt threaded into the nut for selective movement into and out of clamping engagement with the post to secure the post inserted in the cylindrical sleeve in the upright or vertical position; and (c) a plurality of bracing members extending between a second set of spaced locations on the outer frame member, intermediately of the first spaced locations, for stabilizing the outer frame member.

2. A device for stabilizing a plurality of spaced posts in accordance with claim 1, wherein the outer frame member is in the form of a polygon.

3. A device for stabilizing a plurality of spaced posts in accordance with claim 2, wherein the outer frame member is comprised of four angularly oriented outer rods that are fixedly connected to the bracket assemblies positioned in corners of the outer frame member.

4. A device for stabilizing a plurality of spaced posts in accordance with claim 3, wherein the outer rods are made from metal.

5. A device for stabilizing a plurality of spaced posts in accordance with claim 3, wherein the outer rods are connected to the bracket assemblies by welding the ends of the outer rods to the bracket assemblies.

6. A device for stabilizing a plurality of spaced posts in accordance with claim 1, wherein the outer frame member defines a stabilizing plane, each cylindrical sleeve being positioned at one corner of the outer frame member with an axis of the cylindrical sleeve generally perpendicular to the stabilizing plane for receiving the post in an orientation perpendicular to the stabilizing plane.

7. A device for stabilizing a plurality of spaced posts in accordance with claim claim 1, wherein the nut is attached to a rim of the cylindrical sleeve and is positioned so that the axis is generally parallel to the stabilizing plane; said nut also being positioned to allow the bolt to enter the nut at a 135 degree angle to the outer most corner of the outer frame member.

8. A device for stabilizing a plurality of spaced posts in accordance with claim 7, wherein the nut is welded to an upper rim of the cylindrical sleeve.

9. A device for stabilizing a plurality of spaced posts in accordance with claim 1, wherein the bracing members collectively define a bracing square within the outer frame member, said bracing members having ends which are connected to the intermediate locations of each of the outer frame members.

10. A device for stabilizing a plurality of spaced posts in accordance with claim 9, wherein the bracing members are circular shaped.

11. A device for stabilizing a plurality of spaced posts in accordance with claim 9, wherein the bracing members are formed from metal and are welded to the outer frame member.

12. A device for stabilizing a plurality of spaced posts comprising:

(a) an outer frame member having a plurality of angularly oriented outer rods which are in the form of a polygon; said outer frame member defining a stabilizing plane;

(b) a plurality of bracing members extending between a second set of spaced locations on the outer frame member intermediately of the first spaced locations for stabilizing the outer frame member; and (c) a plurality of bracket assemblies, each said bracket assembly being mounted to the outer frame member at a first set of spaced locations thereon, each said bracket assembly comprising:

(i) a cylindrical sleeve positioned at one corner of the outer frame member having an axis generally perpendicular to the axis of the stabilizing plane for receiving a post in an orientation perpendicular to the stabilizing plane;

(ii) a nut attached to the rim of the cylindrical sleeve and positioned so that the axis is generally parallel to the stabilizing plane; and (iii) a bolt threaded into the nut for selective movement into and out of clamping engagement with the post to secure the post inserted in the cylindrical sleeve in the upright and vertical position.

13. A device for stabilizing a plurality of spaced posts in accordance with claim 12, wherein the outer frame member is comprised of four outer rods which are fixedly connected to the bracket assemblies positioned in corners of the outer frame member.

14. A device for stabilizing a plurality of spaced posts in accordance with claim 12, wherein the outer rods are made from metal.

15. A device for stabilizing a plurality of spaced posts in accordance with claim 12, wherein the outer rods are connected to the bracket assemblies by welding the ends of the outer rods to the bracket assemblies.

16. A device for stabilizing a plurality of spaced posts in accordance with claim 12, wherein the nut is positioned on the cylindrical sleeve to allow the bolt to enter the nut at a 135 degree angle to the outer most corner of the outer frame member.

17. A device for stabilizing a plurality of spaced posts in accordance with claim 16, wherein the nut is welded to an upper rim of the cylindrical sleeve.

18. A device for stabilizing a plurality of spaced posts in accordance with claim 12, wherein the bracing members collectively define a bracing square within the outer frame member, said bracing members having ends which are connected to the intermediate locations of each of the outer frame members.

19. A device for stabilizing a plurality of spaced posts in accordance with claim 18, wherein the bracing members are circular shaped.

20. A device for stabilizing a plurality of spaced posts in accordance with claim 19, wherein the bracing members are formed from metal and are welded to the outer frame member.

21. A device for stabilizing a plurality of spaced posts comprising:

(a) a plurality of posts;

(b) an outer frame member having a plurality of angularly oriented outer rods which are in the form of a polygon; said outer frame member defining a stabilizing plane;

(c) a plurality of bracing members extending between a second set of spaced locations on the outer frame member intermediately of the first spaced locations for stabilizing the outer frame member; and (d) a plurality of bracket assemblies, each said bracket assembly being mounted to the outer frame member at a first set of spaced locations thereon, each said bracket assembly comprising:

(i) a cylindrical sleeve positioned at one corner of the outer frame member having an axis generally perpendicular to the axis of the stabilizing plane for receiving the posts in an orientation perpendicular to the stabilizing plane;

(ii) a nut attached to the rim of the cylindrical sleeve and positioned so that the axis is generally parallel to the stabilizing plane; and (iii) a bolt threaded into the nut for selective movement into and out of clamping engagement with the post to secure the post inserted in the cylindrical sleeve in the upright and vertical position.

22. A device for stabilizing a plurality of spaced posts in accordance with claim 21, wherein the outer frame member is comprised of four outer rods fixedly connected to the bracket assemblies positioned in corners of the outer frame member.

23. A device for stabilizing a plurality of spaced posts in accordance with claim 21, wherein the outer rods are made from metal.

24. A device for stabilizing a plurality of spaced posts in accordance with claim 21, wherein the outer rods are connected to the bracket assemblies by welding the ends of the outer rods to the bracket assemblies.

25. A device for stabilizing a plurality of spaced posts in accordance with claim 21, wherein the nut is positioned to allow the bolt to enter the nut at a 135 degree angle to the outer most corner of the outer frame member.

26. A device for stabilizing a plurality of spaced posts in accordance with claim 25, wherein the nut is welded to an upper rim of the cylindrical sleeve.

27. A device for stabilizing a plurality of spaced posts in accordance with claim 21, wherein the bracing members collectively define a bracing square within the outer frame member, said bracing members having ends which are connected to the intermediate locations of each of the outer frame members.

28. A device for stabilizing a plurality of spaced posts in accordance with claim 27, wherein the bracing members are circular shaped.

29. A device for stabilizing a plurality of spaced posts in accordance with claim 28, wherein the bracing members are formed from metal and are welded to the outer frame member.

30. A device for stabilizing a plurality of spaced posts comprising:

(a) a plurality of posts;

(b) an outer frame member comprised of a plurality of angularly oriented, metal outer rods which are in the form of a polygon; said outer frame member defining a stabilizing plane;

(c) a plurality of bracing members extending between a second set of spaced locations on the outer frame member, intermediately of the first spaced locations, for stabilizing the outer frame member; said bracing members being circular shaped, metal bracing members that are welded to the outer frame member, collectively defining a bracing square within the outer frame member; and (d) a plurality of bracket assemblies, each said bracket assembly being mounted to the outer frame member at a first set of spaced locations thereon, each said bracket assembly comprising:

(i) a cylindrical sleeve positioned at one corner of the outer frame member having an axis generally perpendicular to the axis of the stabilizing plane for receiving the posts in an orientation perpendicular to the stabilizing plane;

(ii) a nut attached to the rim of the cylindrical sleeve and positioned so that the axis is generally parallel to the stabilizing plane; and (iii) a bolt threaded into the nut for selective movement into and out of clamping engagement with the post to secure the post inserted in the cylindrical sleeve in the upright and vertical position; said nut being positioned to allow the bolt to enter the nut at a 135 degree angle to the outer most corner of the outer frame member.

* * * * *